US009752368B2

(12) United States Patent
Kwak

(10) Patent No.: US 9,752,368 B2
(45) Date of Patent: Sep. 5, 2017

(54) DOOR CHECKER DEVICE FOR USE IN AUTOMOBILES

(71) Applicant: KWANGJIN MACHINE CO., LTD., Chungcheongnam-do (KR)

(72) Inventor: Byeong Cheol Kwak, Chungcheongnam-do (KR)

(73) Assignee: KWANG JIN MACHINE CO., LTD. (KR)

( * ) Notice: Subject to any disclaimer, the term of this patent is extended or adjusted under 35 U.S.C. 154(b) by 126 days.

(21) Appl. No.: 14/435,644

(22) PCT Filed: Oct. 16, 2013

(86) PCT No.: PCT/KR2013/009258

§ 371 (c)(1),
(2) Date: Apr. 14, 2015

(87) PCT Pub. No.: WO2014/061999

PCT Pub. Date: Apr. 24, 2014

(65) Prior Publication Data

US 2015/0233165 A1 Aug. 20, 2015

(30) Foreign Application Priority Data

Oct. 17, 2012 (KR) ..... 10-2012-0115490

(51) Int. Cl.
*E05C 17/22* (2006.01)
*E05F 5/02* (2006.01)

(52) U.S. Cl.
CPC ..... *E05F 5/025* (2013.01); *Y10T 16/299* (2015.01)

(58) Field of Classification Search
CPC ..... E05F 5/025; Y10T 16/299; Y10T 16/293; Y10T 16/285; Y10T 16/5401;
(Continued)

(56) References Cited

U.S. PATENT DOCUMENTS 6,314,612 B1 * 11/2001 Rennecke ..... E05D 11/1028 16/51
7,506,406 B2 3/2009 Murayama et al.
(Continued)

FOREIGN PATENT DOCUMENTS

JP 06049128 2/1994
JP 2006291559 10/2006
(Continued)

OTHER PUBLICATIONS

International Search Report, International Application No. PCT/KR2013/009258, dated Jan. 7, 2014.

*Primary Examiner* — Victor Batson
*Assistant Examiner* — Matthew Sullivan
(74) *Attorney, Agent, or Firm* — Perman & Green LLP

(57) ABSTRACT

A door checker device for use in automobiles which includes a fixing member attached to one side of the car body, a checker arm having one end hinge-coupled to the fixing member to be rotated, wherein the checker arm is disposed between a door and the car body, and a door checker attached to one side of the door side and engaged with the checker arm to slid along the longitudinal direction of the checker arm, wherein the door checker allows the door to maintain a stationary state at a predetermined position in the swing trajectory of the door.

4 Claims, 7 Drawing Sheets

(58) Field of Classification Search
CPC ..... G06F 1/1681; E05Y 2201/21; E05Y 2900/531; E05D 5/062
See application file for complete search history.

(56) References Cited

U.S. PATENT DOCUMENTS

| | | | | |
|---|---|---|---|---|
| 8,413,302 | B2 * | 4/2013 | Kitagawa | G06F 1/1616 16/320 |
| 8,776,316 | B2 * | 7/2014 | McRoskey | E05F 5/02 16/82 |
| 8,938,852 | B2 * | 1/2015 | Kim | E05C 17/203 16/320 |
| 8,943,649 | B2 * | 2/2015 | Chen | G06F 1/1681 16/320 |
| 9,080,363 | B2 * | 7/2015 | Reed | E05F 5/025 |
| 9,244,497 | B2 * | 1/2016 | Tsai | G06F 1/1681 |
| 9,395,752 | B2 * | 7/2016 | Chen | G06F 1/1616 |
| 2008/0309120 | A1 * | 12/2008 | Kohlstrand | E05D 11/1007 296/146.11 |
| 2009/0007489 | A1 * | 1/2009 | Kern | E05C 17/30 49/31 |

FOREIGN PATENT DOCUMENTS

| | | |
|---|---|---|
| JP | 2008280727 | 11/2008 |
| KR | 100448064 | 9/2004 |

* cited by examiner

DOOR CHECKER DEVICE FOR USE IN AUTOMOBILES

CROSS REFERENCE TO RELATED APPLICATIONS

This application is the National Stage of International Application No. PCT/KR2013/009258 having International filing date 16 Oct. 2013, which designated the United States of America, and which International Application was published under PCT Article 21 (s) as WO Publication 2014/061999 A1 and which claims priority from, and the benefit of, Korean Application No. 10-2012-0115490, filed on 17 Oct. 2012, the disclosures of which are incorporated herein by reference in their entireties.

BACKGROUND

The presently disclosed embodiment relates to a door checker device for use in vehicles, and more particularly, to a door checker device for use in vehicles, which is capable of restraining opening and closing of a door to meet a demand of a passenger and has high durability.

In vehicles, when a door maintains its opening state stably, passengers or drivers may easily get on or off the vehicle through the door or goods may be easily loaded on or unloaded from the vehicle through the door, but a door hinge merely maintains a mounted state of the door and simply allows pivotable opening and closing of the door, failing to allow the door to maintain an open state at a predetermined angle in an opening and closing trajectory of the door.

Thus, in a vehicle, a door checker device is installed in a center portion of a front side of an inner panel of the door, such that the door may maintain a stationary state at two or three points in an opening and closing trajectory of the door.

Such a checker device for a vehicle generally include a fixing member attached to a vehicle body side of the vehicle, a checker arm having an end hinge-coupled to the fixing member to rotate and positioned between the door and a vehicle body, and a door checker that is attached to a door side and receives the checker arm therein to allow the door to maintain a stationary state at a predetermined position in a moving trajectory of the door while sliding along a longitudinal direction of the checker arm.

The checker device includes a base bracket having a predetermined-size space formed therein, a slider received inside the base bracket, a spring positioned in a side of the slider, and a base cover coupled to a side surface of the base bracket.

A conventional door checker device for a vehicle structured as described above operates as described below.

Once the door is opened, the position of the door is changed, such that along with an opened state of the door, the door checker operates on the checker arm together with movement of the door. For example, the door at the topmost position is completely opened, and in this case, the door checker is pushed to the rearmost end portion of the checker arm, together with the door.

In this process, the checker arm moves along the inner space formed in the door checker, such that when the checker arm passes through the inner space, the slider received inside the door checker and a concave groove of the checker arm contact to perform a door checker function of providing a buffering force to an opening force of the door.

Such a conventional checker device has a restricted checker operation range of 2 stages or 3 stages. For example, assuming that when the door is opened at 35°, the door is restricted to one stage, and when the door is opened at 70°, the door is restricted to two stages, then the door may not be opened at 35° or more because another vehicle is parked very closely to a side of the vehicle, and if the door needs to be maintained opened in that case, it becomes difficult to fix the door by using the door checker.

Moreover, if the concave groove is worn out due to long-term use, the door checker may not operate properly, such that the door may be closed even when needing to maintain the opened state, resulting in an accident.

Recently, a technique has been developed which senses an object around the door to prevent the door from being opened by a predetermined amount or more, but a conventional machine-based checker may not be able to derive stop of rotation of the door adaptively for such emergency.

SUMMARY

The presently disclosed embodiment provides a door checker device for use in vehicles, which allows a door to maintain a stationary state at a desired angle and has superior durability.

According to an aspect of the presently disclosed embodiment, there is provided a door checker device for use in vehicles, the door checker device including a fixing member that is attached to a side of a vehicle body, a checker arm that has an end hinge-coupled to the fixing member to rotate and is positioned between a door and the vehicle body, and a door checker that is attached to a side of the door and is engaged to the checker arm to slide along a longitudinal direction of the checker arm, wherein the door checker allows the door to maintain a stationary state at a predetermined position in a swing path of the door, in which the door checker includes a checker panel that is coupled to the side of the door, a first rotation means that is rotatably coupled to the checker panel and is engaged with the checker arm disposed near one surface side of the checker panel in such a way to rotate, and a second rotation means that is disposed on the other surface side of the checker panel, rotates by being interlocked with the rotation means, and has a friction plate, and a stator that is disposed on the other surface side of the checker panel and is capable of restraining the second rotation means while attracting the friction plate of the second rotation means due to an electromagnetic force when an electrical signal is applied thereto.

A portion where the first rotation means and the checker arm are engaged with each other may be positioned on the one surface side of the checker panel.

A receiving portion having a cut hole formed therein, which is bent in a direction away from the stator and is partially cut, may be formed on the checker panel, and the first rotation means may be rotatably supported in the receiving portion and partially leaves the receiving portion through the cut hole in such a way to be engaged with the checker arm.

The stator may be fixed and attached onto the other surface of the checker panel, and the friction plate may be positioned on an opposite side of the checker panel having the stator between the friction plate and the checker panel.

The stator may have a communicating hole in a center thereof, and the second rotation means may further include a rotation body including an insertion portion that is inserted into the communicating hole and is fixed and coupled to the first rotation means and an edge portion that extends outwardly along an edge of the insertion portion and is elastically connected with the friction plate.

The stator may have a communicating hole in a center thereof, and the first rotation means may be positioned on an opposite side of the friction plate, having the stator between the first rotation means and the friction plate, and the second rotation means may further include a rotation body that passes through the communicating hole while being fixed on a side thereof to the first rotation means and is connected near the other side thereof to the friction plate.

The door checker device for use in vehicles according to the presently disclosed embodiment allows the door to be stopped regardless of an angle of the door upon application of an electric signal when the stop of the door is required.

Moreover, in the door checker device for use in vehicles according to the presently disclosed embodiment, the stator is disposed on the other surface side of the checker panel and a portion where the checker arm and the first rotation means are engaged is disposed near one surface side of the checker panel, such that the checker arm may be disposed in adjacent to the checker panel and thus a rotational moment generated during an engaging operation between the checker arm and the first rotation means is minimized, securing structural stability.

DETAILED DESCRIPTION

Figure 1:
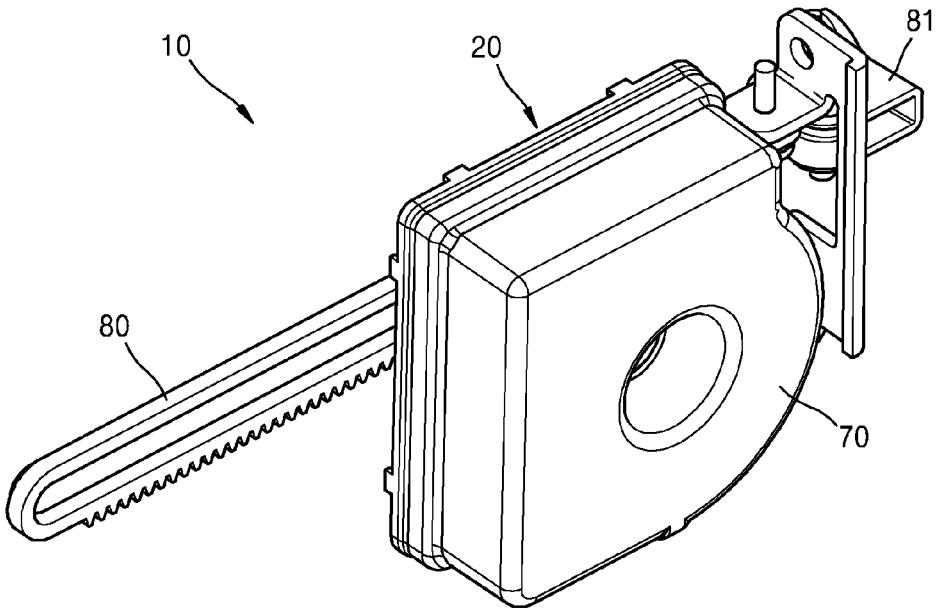
FIG. 1 is a perspective view of a door checker device for use in vehicles according to an embodiment of the presently disclosed embodiment.
Figure 2:
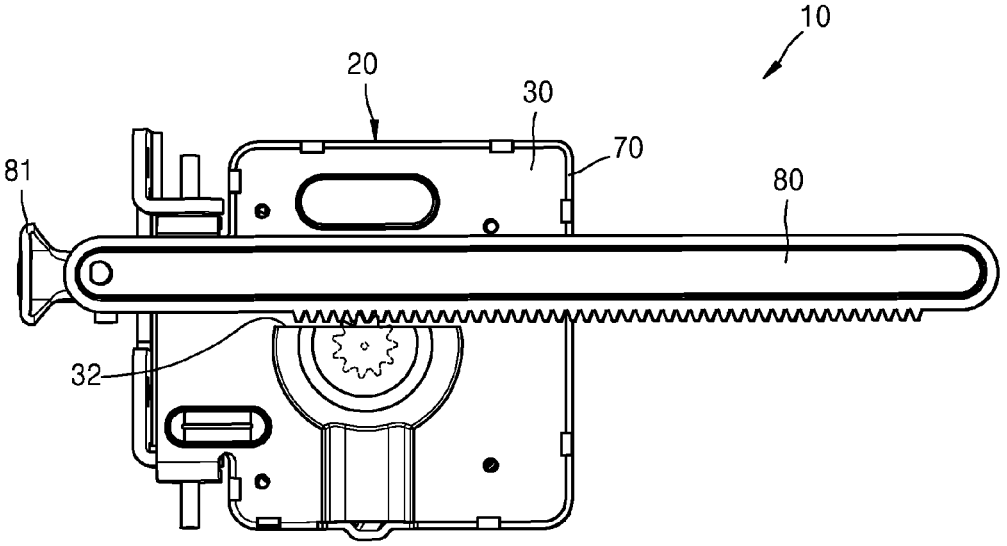
FIG. 2 is a front view of FIG. 1.
Figure 3:
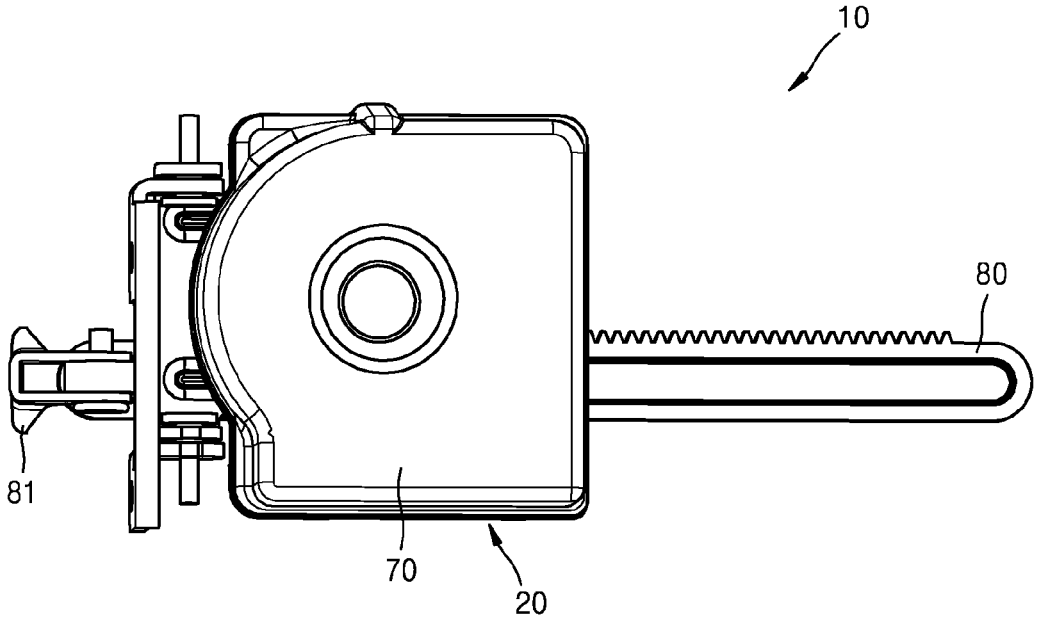
FIG. 3 is a rear view of FIG. 1.
Figure 4:
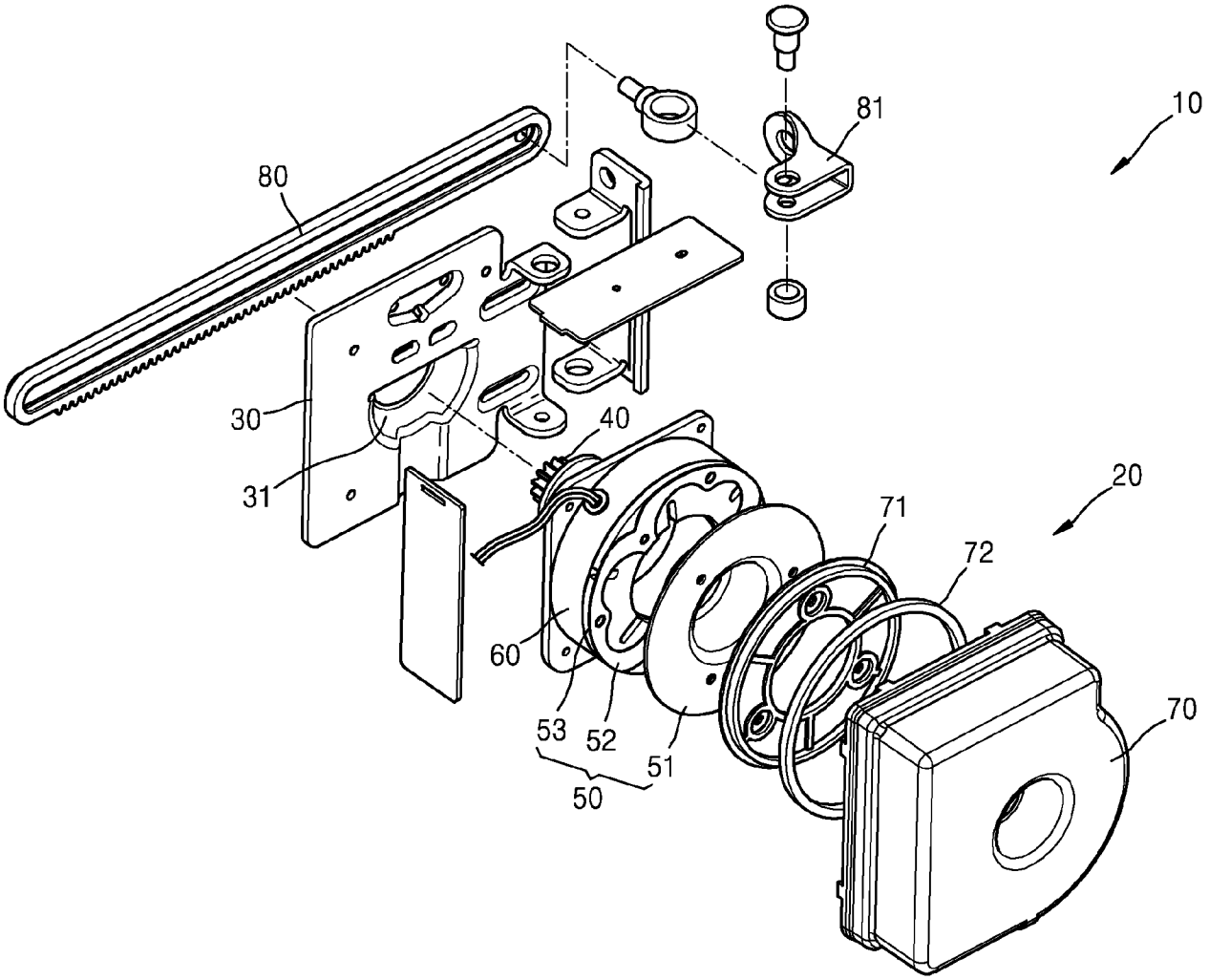
FIG. 4 is an exploded perspective view of FIG. 1.
Figure 5:
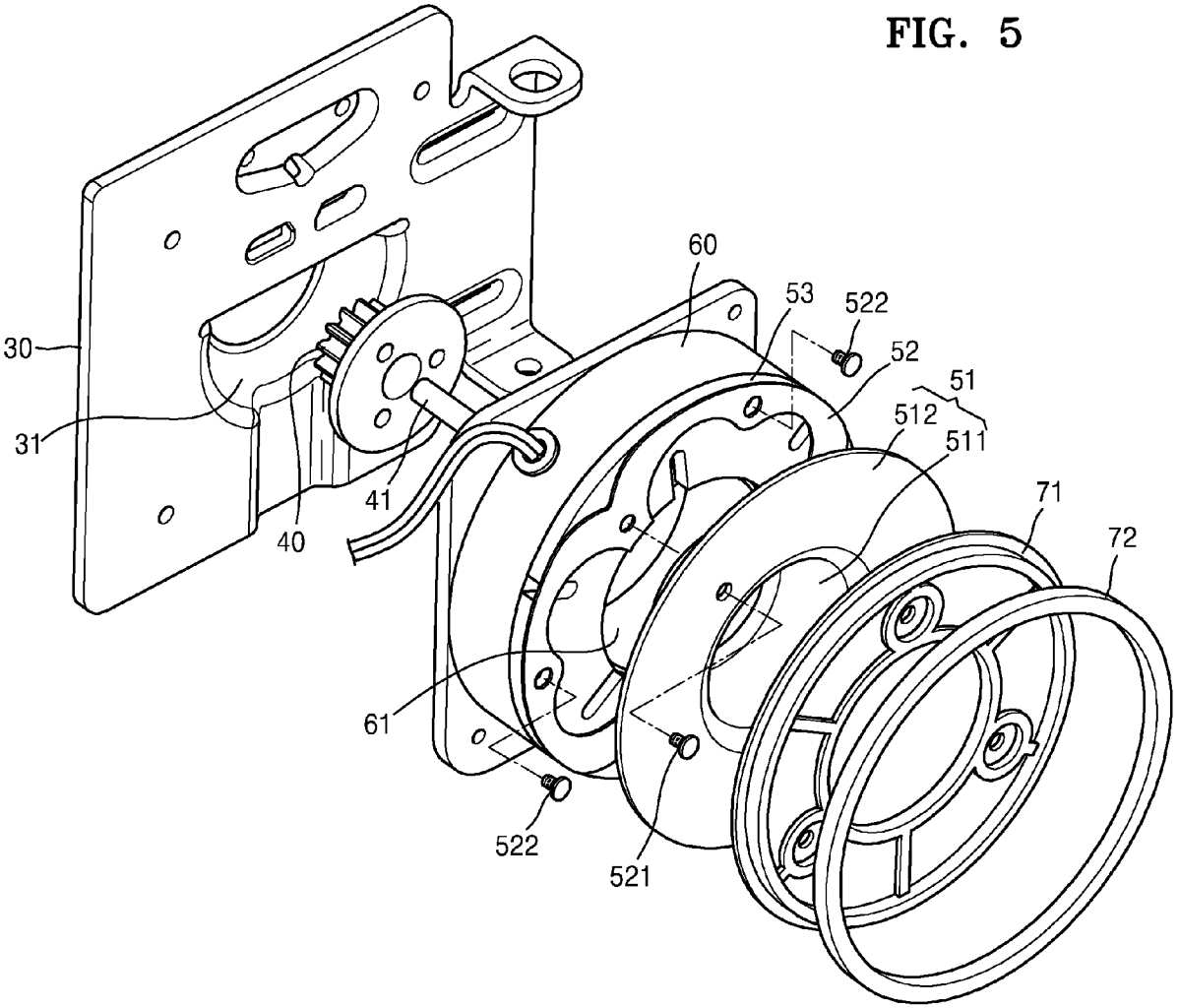
FIG. 5 is a partially-exploded view of FIG. 4.
Figure 6:
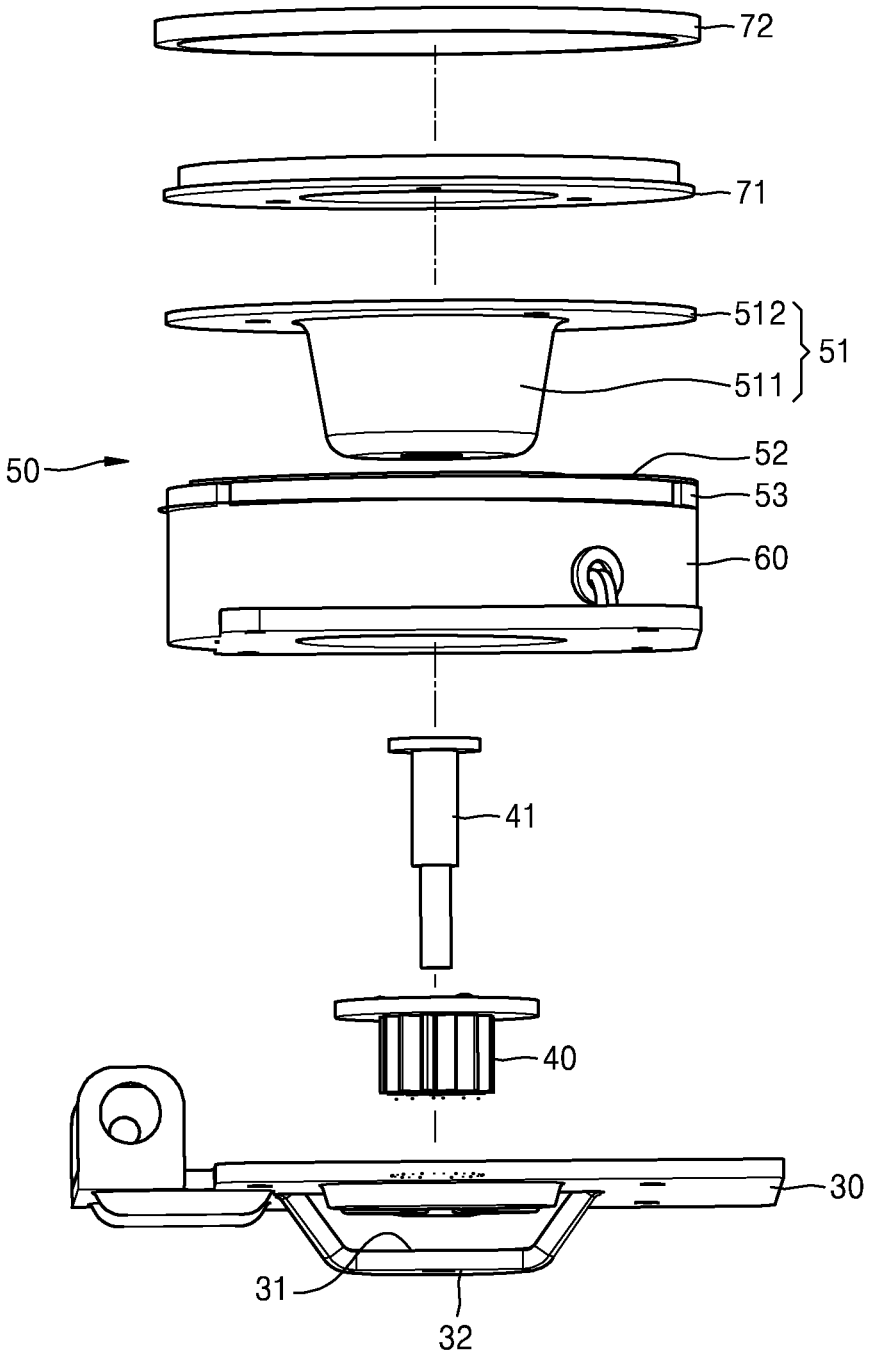
FIG. 6 is a disassembled view of main elements of FIG. 1.

Hereinafter, a door checker device for use in vehicles according to an aspect of the presently disclosed embodiment will be described in detail with reference to the accompanying drawings.

A door checker device 10 for use in vehicles according to the presently disclosed embodiment is the door checker device 10 including a fixing member 81 that is attached to a side of a vehicle body, a checker arm 80 that has an end hinge-coupled to the fixing member 81 in such a way to rotate and is positioned between a door and the vehicle body, and a door checker 20 that is attached to a side of the door and is engaged with the checker arm 80 to slide along a longitudinal direction of the checker arm 80, and allows the door to maintain a stationary state at a particular point in a swing trajectory of the door.

In the door checker device 10 for use in vehicles, the door checker 20 may include a checker panel 30, a first rotation means 40, a second rotation means 50, and a stator 60.

The checker panel 30 is coupled to a cover 70 to provide a receiving space for receiving the first rotation means 40, the second rotation means 50, and the stator 60 therein, and is in the shape of an approximately flat plate, and is installed in a side of the door. The checker panel 30 may be made of a metallic material.

The checker arm 80 is disposed on one side surface of the checker panel 30, and the stator 60 and the second rotation means 50 are installed near the other side surface of the checker panel 30. More specifically, the stator 60 is attached onto the other surface of the checker panel 30. In the center of the checker panel 30, a receiving portion 31 is provided to be bent, protruding in a direction away from the stator (for example, in a direction toward the checker arm 80). The receiving portion 31 has a shape capable of approximately enclosing the first rotation means 40. The receiving portion 31 is provided with a cut hole 32 through which a portion of the first rotation means 40 is exposed toward the checker arm 80, and the first rotation means 40 and the checker arm 80 are coupled in an engaged manner with each other through the cut hole 32.

In the center of the receiving portion 31, a rotation pin 41 is fixedly coupled to rotatably couple the first rotation means 40. The first rotation means 40 may rotate, a center thereof being inserted into the rotation pin 41.

The first rotation means 40 is rotatably coupled to the checker panel 30, and rotates, being engaged with the checker arm 80 disposed near one surface side of the checker panel 30. The first rotation means 40 may be rotatably coupled to the checker panel 30, having the rotation pin 41 inserted thereinto. The first rotation means 40 may be a gear having gear teeth along an outer circumferential surface thereof, and the gear teeth of the first rotation means 40 may be engaged with those of the checker arm 80 to transform linear movement of the checker arm 80 into rotational movement.

The first rotation means 40 is received in the receiving portion 31 and at least some of the gear teeth are engaged with the checker arm 80 through the cut hole 32 and the others are situated in the receiving portion 31.

The second rotation means 50 are disposed on the other surface side of the checker panel 30 and rotate by being interlocked with the rotation means. The second rotation means 50 may include a rotation body 51, an elastic plate 52, and a friction plate 53.

The rotation body 51 is inserted into a communicating hole 61 formed in the center of the stator 60, and may include an insertion portion 511 coupled to the first rotation means 40 and an edge portion 512 that extends outwardly along an edge of the insertion portion 511 and is elastically connected with the friction plate 53 by using the elastic plate 52.

More specifically, the insertion portion 511 is in the shape of an approximately cup, and a bottom surface of the insertion portion 511 contacts the first rotation means 40 such that the insertion portion 511 rotates by being interlocked with the first rotation means 40 using the rotation pin 41. The bottom surface of the insertion portion 511 is disposed in a side of the first rotation means 40, and the insertion portion 511 extends from the bottom surface toward the elastic plate 52 along the communicating hole.

The edge portion 512 extends outwardly from the edge of the insertion portion 511, and has the shape of an approximately ring. The edge portion 512 is connected with the elastic plate 52 through a first pin 521.

The elastic plate 52 is provided between the edge portion 512 and the friction plate 53, and elastically supports the friction plate 53 such that the friction plate 53 is elastically biased toward the edge portion 512. The elastic plate 52 has the shape of an approximately ring shape, such that a portion of the elastic plate 52 is coupled to the edge portion 512 through the first pin 521 and another portion of the elastic plate 52 is coupled to the friction plate 53 through a second pin 522. In a normal state, the friction plate 53 is spaced apart from the stator 60 by means of the elastic plate 52; if an electromagnetic force is generated by the stator 60, the elastic plate 52 allows the friction plate 53 to be drawn toward the stator 60, and after removal of the electromagnetic force by means of the stator 60, the elastic plate 52 moves the friction plate 53 toward the edge portion 512 from the stator 60.

The friction plate 53 is disposed in the edge portion 512 by means of the elastic plate 52, and if an electromagnetic force is generated in the stator 60, the friction plate 53 moves to the stator 60 and is attached to the stator 60 to stop rotation of the second rotation means 50. In a normal state, the friction plate 53 is spaced apart from the stator 60 with a small interval therebetween. The friction plate 53 has a relatively rough surface and thus rotation thereof is restrained by the stator 60 when the friction plate 53 is attached to the stator 60.

The stator 60 is attached to the other surface of the checker panel 30, and upon application of an electric signal, and restrains the second rotation means 50 while attracting the friction plate 53 of the second rotation means 50 using an electromagnetic force. The stator 60 is a general technique as an element of an electronic clutch, and thus will not be described in detail. Upon application of an electric signal to the stator 60, rotation of the second rotation means 50 including the friction plate 53 and rotation of the first rotation means 40 rotating, interlocked with the second rotation means 50, are restrained while attracting the friction plate 53, and upon removal of the electric signal, the friction plate 53 restrains the rotation of the second rotation means 50 including the friction plate 53 and the rotation of the first rotation means 40, as being spaced apart from the stator 60.

The stator 60 is connected with a control means (not illustrated), and if restraint of rotation is needed in the control means, an electric signal may be on or off. The control means interworks with a sensor for sensing an object near the door, such that if an object is sensed near the door, the control means applies an electric signal to the stator 60 to suppress rotation of the rotation means and thus prevent the door from being opened, fixing the position of the door.

Reference numerals 71 and 72 represent a top plate and a ring, respectively. The top plate 71 forms an outer circumference of a rotation means, together with the ring 72. The ring 72 is coupled in the shape of a ring along the outer circumference of the top plate 71. On the surface of the ring 72, a predetermined indicator is provided. A recognition sensor is provided around the ring 72 to recognize the indicator, thus recognizing the number of times the second rotation means 50 rotates.

The door checker device 10 for use in vehicles according to an aspect of the presently disclosed embodiment operates as described below.

Figure 8:
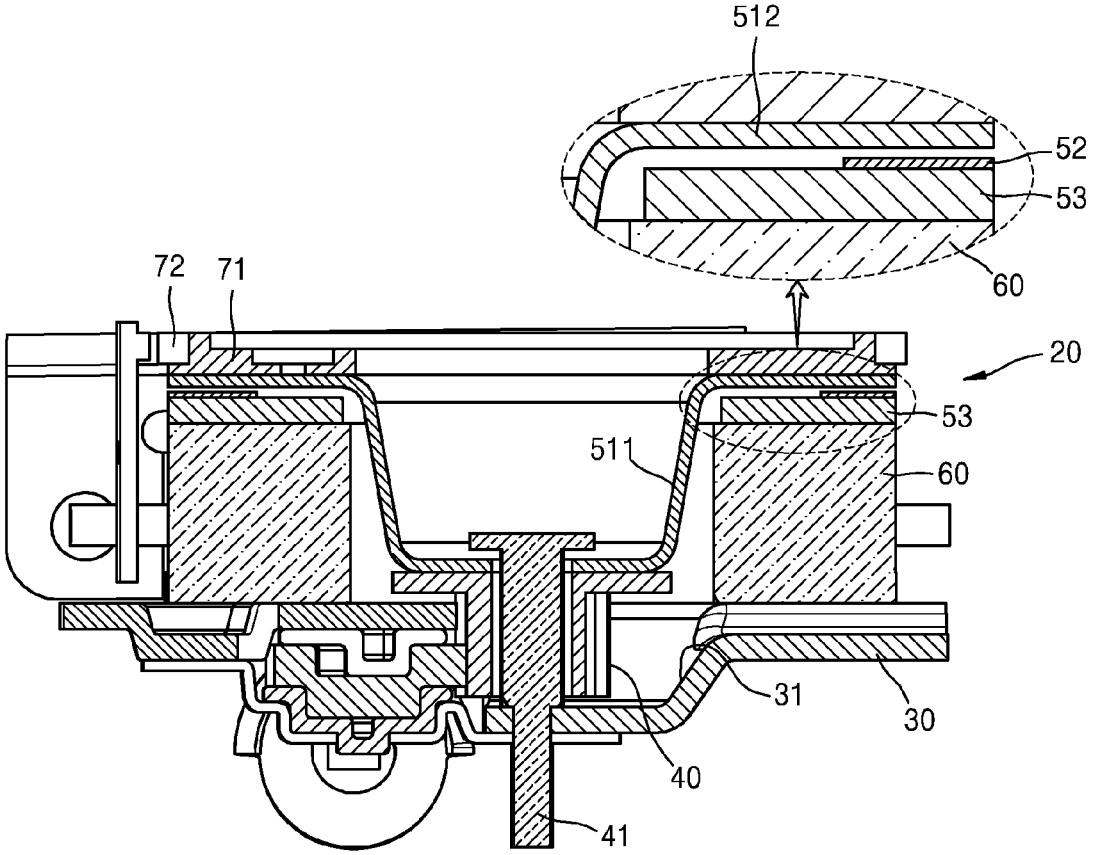
FIG. 8 is an operating view of FIG. 7.

When the door is opened, the checker arm 80 slides with respect to the door checker 20. As the checker arm 80 slides, the first rotation means 40 transforms linear movement of the checker arm 80 into rotational movement. As such, once the first rotation means 40 rotates, the second rotation means 50 also rotates, interlocked with the first rotation means 40. As the first rotation means 40 and the second rotation means 50 rotate, the door swings. If a predetermined object approaches the door, a predetermined recognition sensor senses the object to cause the control means to apply an electric signal. Upon application of the electric signal, the friction plate 53 spaced apart from the stator 60 is attracted to the stator 60 by the electromagnetic force and thus rotation thereof is restrained, as illustrated in FIG. 8. Together with rotation-restraint of the friction plate 53, the second rotation means 50 including the rotation body 51 connected with the friction plate 53 is rotation-restrained and the first rotation means 40 which is rotation-interlocked with the second rotation means 50 is also rotation-restrained. As the rotation of the first rotation means 40 is restrained, the relative linear movement of the checker arm 80 is also restrained, restraining swing of the door and thus fixing the position of the door.

Figure 7:
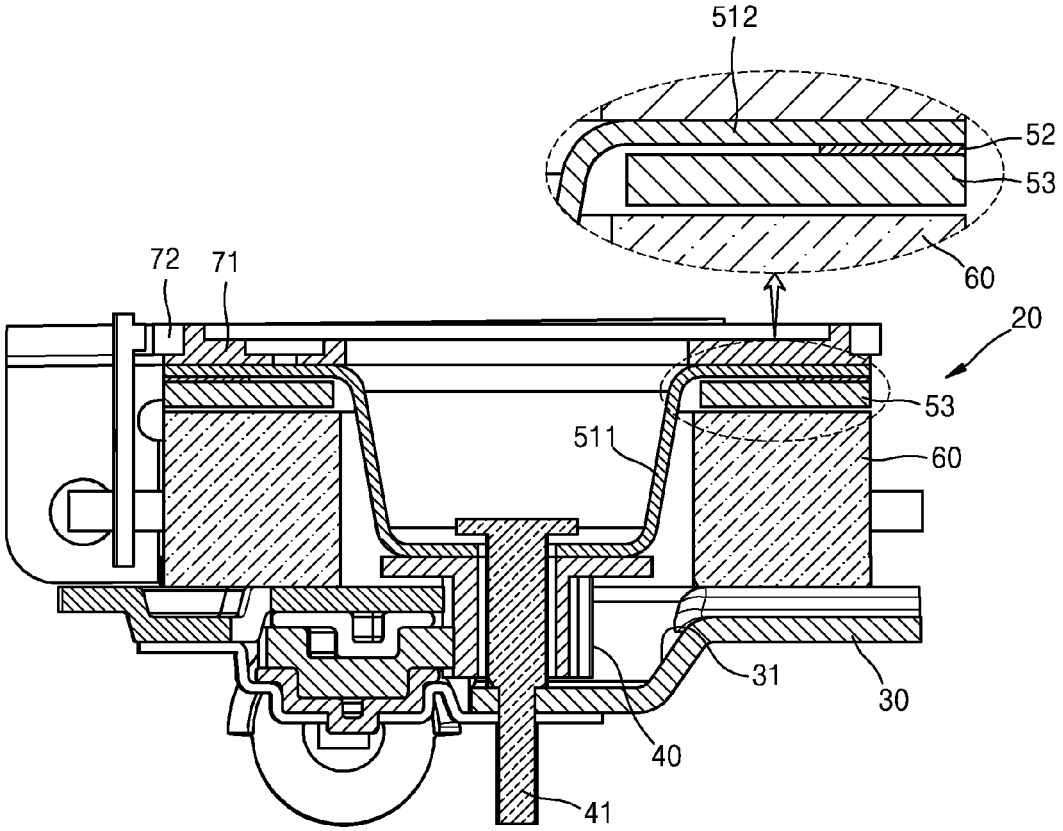
FIG. 7 is a coupled cross-sectional view of FIG. 6.

Meanwhile, if the object around the door is removed or the door is in a swing-possible state, the electric signal applied from the control means is removed, such that the friction plate 53 attached to the stator 60 moves toward its original position, the edge portion 512 of the rotation body 51, due to the elastic plate 52 as illustrated in FIG. 7, thus freely rotating, and the rotation restraint of the rotation body 51 and the first rotation means 40 interlocked with the friction plate 53 is released. Once the rotation restraint of the first rotation means 40 is released, the door may freely swing, allowing the door to freely swing.

The door checker device for use in vehicles according to an aspect of the presently disclosed embodiment has operating effects as described below.

First, the door checker device for use in vehicles according to the presently disclosed embodiment allows the door to be in the stationary state at any position in a swing trajectory, rather than at a particular position. In particular, if an object exists around the door, the door may be freely stopped, of when a driver desires to stop the door at a particular position, the open position of the door may be freely fixed.

Moreover, in the door checker device for use in vehicles according to the presently disclosed embodiment, a position in which the checker arm and the first rotation means are engaged may be close to the checker panel, such that even when a moment force is generated due to engagement between the checker arm and the first rotation means, the moment force may be minimized. That is, depending on a distance of the position in which the checker arm and the first rotation means are engaged with each other from the checker panel, the moment force changes. For example, if the first rotation means is disposed on the friction plate and the checker arm is disposed on the friction plate that is spaced apart from the checker panel, then the distance from the checker panel to the engaged portion increases, such that the moment force may excessively increase and such an excessive load is eventually likely to degrade the structural stability of the door checker device.

In the presently disclosed embodiment, to dispose the first rotation means as closely to the checker panel as possible, the first rotation means is positioned on the opposite side of the friction plate, having the stator between the first rotation means and the friction plate, thus achieving the structural stability, instead of disposing the first rotation means away from the checker panel by disposing the first rotation means serially with respect to the friction plate.

The door checker device for use in vehicles according to an aspect of the presently disclosed embodiment may be modified as described below.

In the foregoing aspect, the checker arm and the first rotation means are engaged with each other by means of gear teeth, but any form may be possible if the form has a typical mechanical structure for delivering linear movement of the checker arm to the first rotation means.

In the above-described aspect, the checker panel has been described as having the shape of a flat plate, but the checker panel may have various shapes without being limited to the flat plate shape. However, if the shape of the checker panel is such that the checker arm is disposed as closely to the checker panel as possible and the first rotation means is disposed while being as close to the checker panel as possible, it may fall within the scope of the presently disclosed embodiment.

While the presently disclosed embodiment has been particularly shown and described with reference to exemplary aspects thereof, it will be understood that various changes in form and details may be made therein without departing from the spirit and scope of the following claims.

What is claimed is:

1. A door checker device for use in vehicles, the door checker device comprising a fixing member that is attached to a side of a vehicle body; a checker arm that has an end hinge-coupled to the fixing member to rotate and is positioned between a door and the vehicle body; and a door checker that is attached to a side of the door and is engaged to the checker arm to slide along a longitudinal direction of the checker arm, wherein the door checker allows the door to maintain a stationary state at a predetermined position in a swing path of the door, wherein the door checker comprises:

a checker panel that is coupled to the side of the door;

a first rotation means that is rotatably coupled to the checker panel and is engaged with the checker arm disposed near one surface side of the checker panel in such a way to rotate;

a second rotation means that is disposed near the other surface side of the checker panel, rotates by being interlocked with the rotation means, and has a friction plate; and a stator that is disposed near the other surface side of the checker panel and is capable of restraining the second rotation means while attracting the friction plate of the second rotation means due to an electromagnetic force when an electrical signal is applied thereto;

wherein a portion where the first rotation means and the checker arm are engaged with each other is positioned near the one surface side of the checker panel; and wherein a receiving portion having a cut hole formed therein, which is bent in a direction away from the stator and is partially cut, is formed on the checker panel, and the first rotation means is rotatably supported in the receiving portion and partially leaves the receiving portion through the cut hole in such a way to be engaged with the checker arm.

2. The door checker device of claim 1, wherein the stator is fixed and attached onto the other surface of the checker panel, and the friction plate is positioned near an opposite side of the checker panel having the stator between the friction plate and the checker panel.

3. A door checker device for use in vehicles, the door checker device comprising a fixing member that is attached to a side of a vehicle body; a checker arm that has an end hinge-coupled to the fixing member to rotate and is positioned between a door and the vehicle body; and a door checker that is attached to a side of the door and is engaged to the checker arm to slide along a longitudinal direction of the checker arm, wherein the door checker allows the door to maintain a stationary state at a predetermined position in a swing path of the door, wherein the door checker comprises:

a checker panel that is coupled to the side of the door;

a first rotation means that is rotatably coupled to the checker panel and is engaged with the checker arm disposed near one surface side of the checker panel in such a way to rotate;

a second rotation means that is disposed near the other surface side of the checker panel, rotates by being interlocked with the rotation means, and has a friction plate; and a stator that is disposed near the other surface side of the checker panel and is capable of restraining the second rotation means while attracting the friction plate of the second rotation means due to an electromagnetic force when an electrical signal is applied thereto;

wherein the stator is fixed and attached onto the other surface of the checker panel, and the friction plate is positioned near an opposite side of the checker panel having the stator between the friction plate and the checker panel; and wherein the stator has a communicating hole in a center thereof, and the second rotation means further comprises:

a rotation body comprising:

an insertion portion that is inserted into the communicating hole and is fixed and coupled to the first rotation means; and an edge portion that extends outwardly along an edge of the insertion portion and is elastically connected with the friction plate.

4. A door checker device for use in vehicles, the door checker device comprising a fixing member that is attached to a side of a vehicle body; a checker arm that has an end hinge-coupled to the fixing member to rotate and is positioned between a door and the vehicle body; and a door checker that is attached to a side of the door and is engaged to the checker arm to slide along a longitudinal direction of the checker arm, wherein the door checker allows the door to maintain a stationary state at a predetermined position in a swing path of the door, wherein the door checker comprises:

a checker panel that is coupled to the side of the door;

a first rotation means that is rotatably coupled to the checker panel and is engaged with the checker arm disposed near one surface side of the checker panel in such a way to rotate;

a second rotation means that is disposed near the other surface side of the checker panel, rotates by being interlocked with the rotation means, and has a friction plate; and a stator that is disposed near the other surface side of the checker panel and is capable of restraining the second rotation means while attracting the friction plate of the second rotation means due to an electromagnetic force when an electrical signal is applied thereto;

wherein the stator is fixed and attached onto the other surface of the checker panel, and the friction plate is positioned near an opposite side of the checker panel having the stator between the friction plate and the checker panel; and wherein the stator has a communicating hole in a center thereof, and the first rotation means is positioned near an opposite side of the friction plate, having the stator between the first rotation means and the friction plate, and the second rotation means further comprises a rotation body that passes through the communicating hole while being fixed on a side thereof to the first rotation means and is connected near the other side thereof to the friction plate.

* * * * *